United States Patent [19]

Woodward

[11] 4,082,053

[45] Apr. 4, 1978

[54] MULTIRUDDER STEERING SYSTEM FOR MULTIHULL BOATS

[76] Inventor: William R. Woodward, 520 E. 76th St. (Apt. 8C), New York, N.Y. 10021

[21] Appl. No.: 728,067

[22] Filed: Sep. 30, 1976

[51] Int. Cl.[2] ..... B63H 25/06

[52] U.S. Cl. ..... 114/163; 114/39; 114/61

[58] Field of Search ..... 114/39, 61, 162, 163, 114/164

[56] References Cited

U.S. PATENT DOCUMENTS

| | | | |
|---|---|---|---|
| 1,780,767 | 11/1930 | Scott-Paine | 114/163 |
| 2,585,599 | 2/1952 | Tchetchet | 114/61 |
| 3,083,382 | 4/1963 | Havens et al. | 114/61 X |
| 3,223,065 | 12/1965 | Wilson, Jr. | 114/39 |
| 3,922,994 | 12/1975 | Long | 114/39 |

FOREIGN PATENT DOCUMENTS

| | | | |
|---|---|---|---|
| 2,027,004 | 12/1971 | Germany | 114/163 |
| 2,131,562 | 1/1972 | Germany | 114/62 |

*Primary Examiner*—Stephen G. Kunin
*Assistant Examiner*—Sherman D. Basinger
*Attorney, Agent, or Firm*—William R. Woodward

[57] ABSTRACT

In a twin hull boat, a rudder mounted in the space between the hulls and forward of the middle of the boat is connected to the rudder or rudders at or near the stern of the boat for deflection in the direction opposite to that of the stern rudder or rudders, the deflection being relatively less, the closer the forward rudder is to the middle of the boat. In a trimaran, a forward rudder is provided on each side of the main hull in the space between the main hull and the outer hull and these rudders are similarly linked to the movement of the rudder at or near the stern of the main hull. Laterally offset rudders, the forward rudders in the case of a trimaran, and aft rudders on the respective hulls of a catamaran, are so interconnected in the steering system that whichever rudder is on the inside of a turn being performed, it is given a greater deflection than the rudder on the outside of the turn. Forward rudders are shown that are designed to be raised when the boat is under sail under a course other than a close-hauled one, and an arrangement is also shown for releasing the linkage between the forward and stern rudders when the boat is being sailed offwind.

23 Claims, 12 Drawing Figures

MULTIRUDDER STEERING SYSTEM FOR MULTIHULL BOATS

This invention relates to apparatus for steering boats of the multihull type, and more particularly apparatus for steering such a boat which includes at least one rudder fin located foward of amidships.

Multihull boats, particularly sail-carrying catamarans and trimarans, are noticeably more difficult to steer than monohull craft, especially when the steerage way falls to a low value, which it commonly does when a relatively light-displacement craft is put about. Thus, in larger sailing catamarans, the practice has developed of sailing to windward with the board in the windward hull down, rather than the one in the lee hull, which is deeper in the water, because this practice makes it easier to put the boat about.

Forward rudders have been proposed for monohull boats, particularly in double-enders provided with a rudder at either end, sometimes merely for use one at a time according to the direction of motion and sometimes to be used together. Rudders forward of amidships have been proposed for monohull boats extending below the bottom of the boat and there have also been proposed flow deflecting devices at the side of a monohull boat, usually about a non-vertical axis, to cause a speed boat to bank around a turn, for example.

In both monohull and multihull boats, multiple stern rudders arranged for the one on the inside of the turn to be deflected to a greater extent have also been proposed to improve the efficiency of steering.

As explained further below, forward rudders have been found inconvenient or undesirable heretofore and have not gone in to very much use. Proposals for auxiliary rudders other than at the stern likewise do not appear to have had any effect on the construction of sailing crafts.

It is an object of the present invention to improve the steering system of multihull craft to make rotation of the boat about a more or less midships vertical axis more efficient while operating under sail.

SUMMARY OF THE INVENTION

Briefly, at least one steering fin rotatable about a substantially vertical axis is provided in a space between hulls of the craft, well forward of amidships, and is steered at the same time as the stern rudder or rudders of the craft, In a catamaran, a single forward steering fin is provided forward of amidships between respective wetted portions of the the two hulls and in a trimaran, two such forward steering fins are provided, one in each inter-hull space.

The forward steering fins are rotated in a direction opposite to the rotation of the rudder blade or blades in response to a single steering control. Preferably, the angle of rotation of the forward steering fins is less than that of the rudder or rudders approximately in proportion to relative distance from amidships. Preferably, when two side-by-side steering elements are provided (forward fins in a trimaran, rudders in a catamaran), the blade on the inside of the turn is given a greater deflection.

Forward steering fins are quite unsuitable for monohull surface vessles because they cannot be located where they will not be easily subject to damage in navigation and where they can be easily controlled in coordination with a stern rudder.

Forward fins, either fixed or for steering, have generally been avoided in the past because of an inherent destabilizing effect. Whereas a stern rudder, when it produces turning of the steered craft, reduces its angle of attack with respect to the original direction of motion (in which the craft tends to continue moving by virtue of inertia, i.e. by Newton's first law of motion), a forward fin increases its angle of attack as the vessel is turned while still tending to move in the original direction, raising a risk of over-steering. Hence more than a return to center position may be necessary in order to avoid over-steering. This is important where wave action causes a boat to yaw. With appropriate fin and rudder areas and disposition, however, a vessel operating at the speeds of the usual sailing vessel can be steered without difficulty, and when a major change of course is necessary, a good response is possible even when the vessel's way falls off sharply as it turns.

In the previously mentioned trimaran case, the increased deflection of the fin on the inside of the desired turn helps to bring the vessel around more quickly by its greater drag when a sharp turn is desired.

Finally, the forward fins can, if desired, be releasable at will from their tie-in with the rudder, so that when a nearly straight course is being maintained, or whenever the vessel is moving relatively fast, the forward fin or fins can be allowed to yield to the direction of movement like a furniture caster. One or more markers on the steering interlock cable can facilitate engaging the combined steering at a moment when the rudder(s) and fin(s) are in a correct relative position.

Instead of being made releasable from steering control, a forward fin can be arranged so that it can be raised partly or entirely out of the water when the boat is sailing off wind and moving fast. This is particularly convenient for the catamaran case.

A steering fin located between the hulls of a multihull vessel can operate in water which is essentially undisturbed by an adjacent hull. The fin and its control cables or other control mechanism can thus be located where they will not be damaged when the vessel comes alongside of another vessel or of a pier, or even when the vessel is beached (assuming in this last case that the same precautions regarding depth and/or retraction are taken as in the case of the stern rudder). For these reasons, the forward steering fin or rudder location should be well aft of the bows of the vessel.

The statements above that the forward steering fin(s) should be forward of amidships means that they should be forward of the point about which the vessel tends to turn when steered, which for the purpose of this description is defined as the midship point. In other words, what is meant is the dynamic center in the plane of flotation with respect to a vertical turning axis, and this may be affected, of course, by the presence of a centerboard under normal on-the-wind sailing conditions. Likewise, the presence of the forward steering element in normal use while going to windward will affect the steering balance which is to be established for effective close-hauled sailing. The proper location of a centerboard must of course take the presence of the forward steering element or elements into account.

The invention is further described in the way of illustrative examples of embodiments with reference to the annexed drawings, in which.

Figure 1:
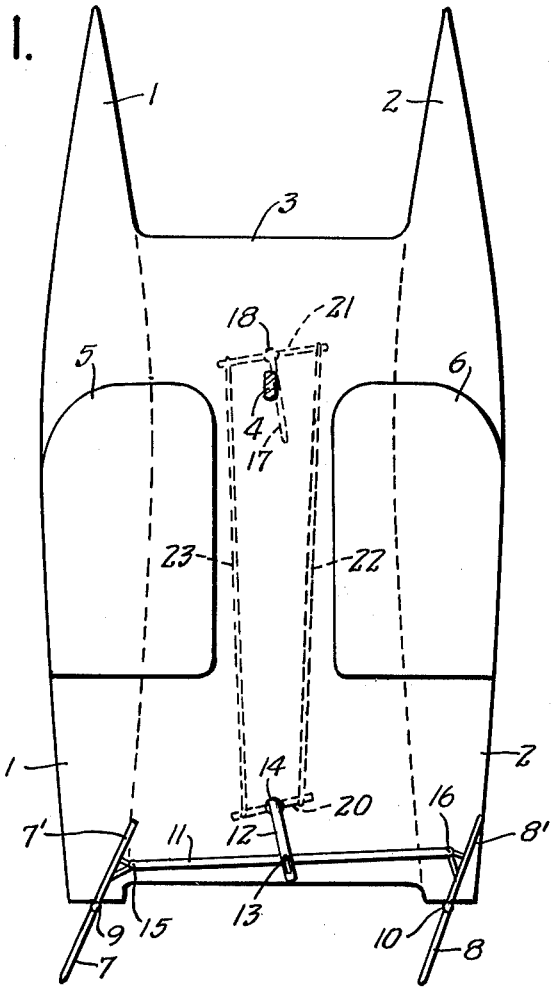
FIG. 1 is a plan diagram of a catamaran equipped with a steering system according to the present invention.

FIG. 1 is an outline plan of a catamaran with a diagram of its steering system according to the invention. The catamaran has two hulls 1 and 2 which are firmly fixed in relation to each other by a connecting deck or "wing" 3. FIG. 1 represents a catamaran of sufficient size for overnight cruising, so that the hull may be, for example, about seven meters long and the total width about half that much, dimensions that are about a minimum for cruising accommodations. Cabin trunks 5 and 6 are provided above the mid portion of the hulls and overlap the deck 3 to increase the sheltered space without increasing the hull width below the deck level. In a craft of the size mentioned, the construction would normally attempt to allow most of the central portion of the craft between the hulls to be disassembled from the rest so that, for purposes of overland transportation on a trailer, the hulls could be put fairly closely together and the center portion carried above them along with unrigged spars and the like, so that the loaded trailer would not occupy more than eight feed width on the highway. In such cases the deck 3 is conveniently provided as a rather simple platform appropriately braced by means not shown in the drawing. The mast 4 is typically located as shown by the shaded rectangle on the diagram.

The hulls 1 and 2 respectively carry stern rudders 7 and 8 pivoted respectively at 9 and 10. The respective tillers 7′ and 8′ of these rudders are linked by a cross bar 11. Instead of the conventional linkage by a bar pivoted at each end at a point on the tiller, the tillers are equipped with offset brackets providing inwardly offset pivots 15 and 16 for the ends of the bar 11. This has the advantage that as the rudders 7 and 8 are moved out of their center position by manipulation of one of the tillers 7′ or 8′, the cross link 11 will gradually twist out of its athwartships direction and thus shorten its effective length, bringing the tillers 7′ and 8′ closer together the more the rudders are moved away from center position. This will happen such a way that the rudder which is on the inside of the desired turn will be more sharply deflected than the other one. This enables the hull which travels around the outside of the turn, and therefore follows a path of greater radius of curvature, to avoid being unnecessarily dragged by its rudder, while the inside hull which necessarily goes on a shorter path in a turn is provided with more rudder deflection to accord with the slowed-down motion through the water. An arm 12 pivoted on a jack shaft 14 is linked to the center of the cross link 11 by a pivot stud 13 mounted on the cross link 11 and passing through a slot 12′ in the arm 12, so that the motion of the cross link 11 will be translated into rotation of the shaft 14 for further transmission of the steering command to the forward rudder 17 mounted on the forward rudder post 18 through a linkage located below the deck 3 making use of the cross arms 20 and 21 the extremities of which are connected by the cables 22 and 23. It will be observed that the radius of the forward point of attachment of the cables 22 and 23 with respect to the center of the rudder post 18 is somewhat greater than the radius of the points of attachments of these cables on the cross arm 20 with respect to the center of the shaft 14. This is because it is desired to produce deflection of the rudder 17 that is somewhat less than the average deflection of the rudders 7 and 8 represented by the position of the arm 12. This is, as explained below, because the rudder post 18 is located much nearer the center of the vessel than are the stern rudders. The effective radius of the arm 12 comes into account in this connection and it may be assumed for the purpose of the present explanation that when the rudders are in their center position, the radius of the pivot stud 13 with respect to the axis of the shaft 14 is the same as that of the pivots 15 and 16 with respect to the centers of the respective rudder posts 9 and 10. The closer the forward rudder post 18 is to the turning center of the vessel, which is to say the point about which it turns when steered, the less the rudder 17 should be deflected in proportion to the deflection of the arm 12 and hence of the rudders 7 and 8. This is because as the vessel turns, the rudder at the end of the boat is subjected a considerable transverse component of motion which reduces its effective angle of attack, whereas a rudder nearer the center of rotation is subjected to only a small transverse displacement in response to steering and the effective angle of attack is not much reduced and a smaller rudder deflection therefore serves to avoid unnecessary drag and to provide at the same time a substantial contribution to steering.

Figure 3:
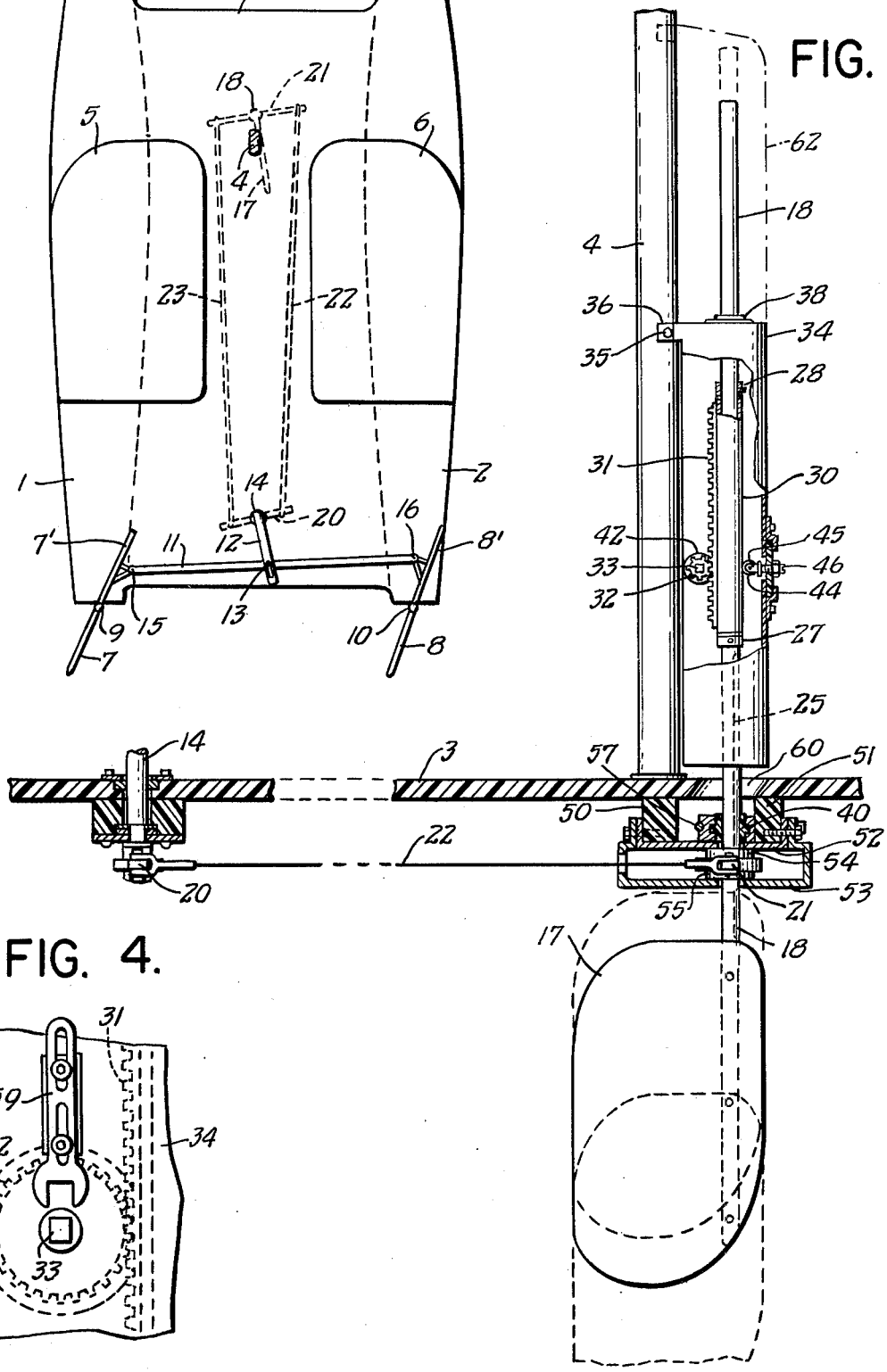
FIG. 3 is a side view, partly in section, of the forward rudder of the system of FIG. 3 and its control connection with the elements of the system shown in FIG. 2.

As illustrated in FIG. 3, the position of the rudder 17 and its shaft or post 18 is selected in the illustrated case because it allows the mast 4 to be used as a support for a mechanism for raising and lowering the rudder 17. That is not only convenient for the provision of support for such a mechanism, but the close proximity of the above-deck portion of the rudder post and its raising mechanism to the mast avoids the provision of a projection above the deck in which the running rigging of a sailing vessel would get fouled. In larger catamarans with a cabin extending across the deck, the front cabin wall or an abutment thereto can similarly be used for supporting and locating the front rudder instead of the mast.

Figure 4:
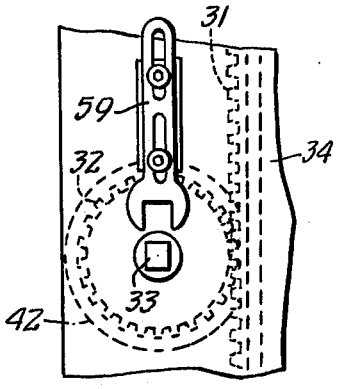
FIG. 4 is a detail showing the lock for the raising and lowering mechanism for the forward rudder shown in FIG. 3.

The raising and lowering device shown in FIG. 3 is a simple rack and pinion device, operated by a removable crank handle, now shown, and secured in fixed position by a sliding latch as shown in FIG. 4. Since the rudder post is positioned over a relatively long vertical span because of the availability of the mast, a skeg below the deck is unnecessary and the rudder is illustrated as a kind of spade rudder which extends forward of the rudder post only just enough to make it easy to fasten the blade to the shaft 18. The control cross arm 21 must be able to slide on the shaft 18 as the latter is raised or lowered without losing its control engagement, of course. This may be provided for by cutting one or more spline grooves in the shaft 18 which the dashed line 25 may represent, for example, in which case the hub of the cross arm 21 will have internal ridges fitting into the groove or grooves. Alternatively the shaft may be given a square or hexagonal cross-section between the top of the rudder blade 17 and the seat of the bearing 27, in which case the hub of the cross member 21 will have a corresponding internal shape and may, of course, as is evident, be made in two parts bolted together about the shaft for mounting it thereon, so that it will have enough clearance to slide but be tight enough to transmit turning motion without excessive play. A tubular member 30 carrying a rack 31 along its length on the side facing the mast 4 is mounted by bearings 27 and 28 at its extremities which engage grooves (not shown) in the shaft 18. The bearings 27 and 28 are therefore in effect thrust bearings, since they hold the weight of the rudder post 18 and its rudder. Since the rudder post 18 does not turn through an arc of more than about 100 to 150° in extreme cases, it is not necessary for these bearings to permit the shaft 18 to revolve to any greater extent and certainly not necessary for these bearings to allow it to make a complete revolution relative to the tube 30, which must of course not turn on its own axis. The rack 31 is engaged by a pinion 32 mounted on a shaft 33 held in a channel casing 34 fastened to the mast at 35 by means of extension tabs 36. The channel casing 34, which is preferably of corrosion-resistant metal, but may be of tough plastic such as a glass-fiber-reinforced resin, has a top closure which carries a bearing 38 that together with a below-deck bearing 40 determines the alignment of the rudder shaft 18 which turns freely in these bearings. These bearings also permit vertical movement of the shaft 18 through them.

The pinion 32 has flanges 42 overlapping respectively both sides of the rack 31, thus preventing the tube 30 from turning with the rudder shaft 18 and keeping the rack 31 in alignment with the pinion 32 to preserve the function of these two members. An elastic roller 44 is mounted in the channel casing 34 and it is shaped so as to effectively press and center the tube 30 with respect to the channel 34 to assure that the rack 31 will remain in secure engagement with the pinion 32. For this purpose, the axle of the roller 44 is held in slots (not shown) in the casing 34 and also passes through holes of a strap 45 inside the casing 34 straddling the roller 44, so that a set screw 46 can adjust the pressure of the roller 44 against the tube 30. It is not necessary for the channel casing 34 to extend below the mountings of the shafts of the pinion 32 and the roller 44, but as a matter of appearance it is convenient to extend this channel casing close to the surface of the deck 3 as shown in FIG. 3. A bracing beam 50 is shown in cross-section immediately below the mast 4. A short beam or block 51 is provided forward of the shaft 18 for mounting a first bearing strip 52 fitted on the beam 50 and likewise a second bearing strip 53, which together form a frame holding an upper bearing 54 and a lower bearing 55 for holding and vertically restraining the hub of the cross member 21 while allowing it to rotate with the shaft 18. Strips 52 and 53 and the bearings 54 and 55 all have clearance between them and the shaft 18 because they are for holding the cross member 21, whereas the shaft 18 is held by the bearing 40 which is attached firmly to the block 51 by a U-bolt 57. It may be desirable to center the bearings 54 and 55 by a lip (not shown) engaging the external or internal circumferences of these bearings. The nature of the bearings 54 and 55 depends on the size of the rudder and the size of the vessel and may be as simple as a lubricated washer. The jack shaft 14, since it does not need to be shifted vertically, may be quite simply mounted, as shown in FIG. 3, by bearings that fix its vertical position.

As already mentioned, FIG. 4 shows a simple sliding lock member 59 for securing the vertical position of the shaft 18 once it has been set by cranking the pinion 32 with a removable crank (not shown). The mechanism shown in FIG. 3 permits ready removal of the rudder 17 and the shaft 18 from its mounting when the vessel is unrigged for transportation or storage. The strips framing the bearing for the cross member 21 are first unfastened from the blocks 50 and 51 and the U-bolt 57 is released so as to free the bearing 40. The cables 22 and 23 can then be disconnected from the cross member 21, or the cross member 20, or both. Removal of the shaft 18 can be facilitated by disconnecting the fastening 35 of the casing 34 on the mast and allowing the top of the shaft 18 to swing forward. The hole 60 through the deck 3 is longitudinally and obliquely extended to facilitate withdrawing the rudder and shaft obliquely downward. The operation can of course be facilitated by releasing the set screw 46.

It should also be mentioned that in order to prevent fouling of running rigging when the vessel is underway with rudder 17 in its raised position, the lightweight shell indicated by the dot-dash line 62 should be provided above the upper end of the channel casing 34.

As is normal for sailing vessels, the trim and balance is normally optimized for sailing to windward. This is when the forward rudder 17 is of greatest value since the most serious steering problem in sailing is presented by tacking the vessel, because the absence of the weight of a keel results in the vessel losing headway more easily and the fine lines of the two hulls may make turning difficult. However, the turning effort in the preferred form of the present invention is also facilitated by the greater deflection of that one of the two stern rudders which is on the inside of the turn. The presence of the forward rudder 17 affects the balance of the sailing trim, of course, but this can be compensated for by the location of the centerboard or centerboards used or by other equivalent changes either in the profile of the vessel or in the position of the lateral center of effort of the sail plan, which may be shifted slightly forward either by shifting the mast or increasing the fore triangle base. Only a small shift is necessary, so even if this is done by shifting the mast slightly forward, the slight forward shift of the rudder post 18 at the same time will not make the desired compensation unobtainable.

When the vessel is not working to windward or otherwise sailing close-hauled, the steering requirements are reduced, particularly on the faster points of sailing. When the vessel is being sailed for a considerable time on a down-wind course, the rudder 18 may be raised by the mechanism shown in FIG. 3, just as it is also customary to raise the centerboard or centerboards either when the vessel is running free or when it is on a course in which the hull provides adequate resistance to transverse drift and the reduction of wetted surface improves speed.

On the other hand, whatever the point of sailing, the forward rudder 17 may be of great advantage in maneuvering in a harbor and this will also be true when the vessel is running in busy lanes or harbor approaches under power by means of an auxiliary engine (not shown).

Figure 5:
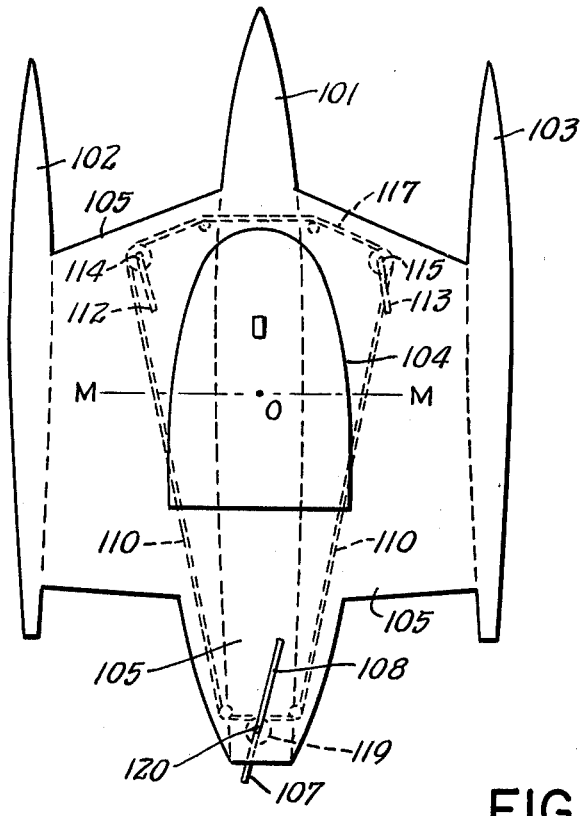
FIG. 5 is a plan view diagram of a trimaran equipped with a steering system according to the present invention.

FIG. 5 shows a steering system according to the invention for a trimaran, in a diagrammatic plan view. The vessel shown has a main hull 101 and auxiliary hulls 102 and 103, the latter sometimes being referred to as floats or by various other names. The cabin 104 over the main hull 101 extends out over the deck 105 that is supported by the beams (not shown) that connect the hulls together. The outer portions of the deck 105 may be constituted by a framed support netting rather than by a solid deck. A stern rudder 107 is mounted on the rear hull, this time not an outboard rudder as was shown in FIG. 1, but one mounted on a rudder post that passes through the bottom of the hull at a place near the stern where it is only a few inches below the water line. The tiller 108 by which the boat is steered is connected by a cable 110 with two forward rudders 112 and 113 swinging on axes 114 and 115 that are in turn fixed relative to the deck 105 and extend below it. A second cable 117 connects the forward rudders 112 and 113 to complete the cabling system, so that all three rudders are positively steered by the tiller 108.

A cabled linkage of the rudders for steering is convenient in this case, since the cable can be guided by pulleys so as to run mostly on the underside of the deck and to run across the hull 101 at a convenient place forward which will not interfere with the cabin space.

Figure 6:
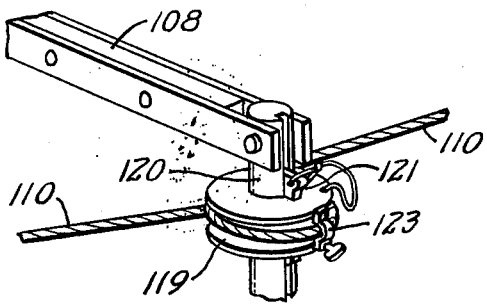
FIG. 6 is a detailed perspective view of a releasable connection of the rudder post of the stern rudder of the remainder of the system illustrated in FIG. 5.

As shown in FIG. 5, the forward rudders are steered so that the one on the inside of a turn will be deflected more than the one on the outside of the turn, just as was the case with the stern rudders in FIG. 1. This is accomplished in the present case by the provision of cams that are rotated by the forward rudders so as to vary the radius at which the cable comes off the cam or winds on the cam in response to the steering motion. At the stern rudder the cable is shown wound around a shallow spool 119 keyed to the stern rudder post 120, as shown in FIG. 6, by a removable spline 121. The cable 110 is clamped by a clamping device 123 to the spool 119. The vertical position of the spool 119 on the rudder post 120 is maintained by means not shown, such as a collar on the rudder post 120 below the position of the spool 119. The radius of the surface on the spool 119 on which the cable 110 is wound around is smaller than the mean radius of the cams on the shafts 114 and 115 which are shown in more detail in FIG. 9. This is so that the deflection of the stern rudder 107 during steering will be relatively greater than that of the forward rudders 112 and 113, for the same reasons that were explained with respect to FIG. 1. The circular shape of the spool 119 assures that the cable 110 will be advanced around its course to an extent directly proportional with the angular displacement of the tiller 108 and that the attitude of the tiller 108 does not change the length of the cable connection to the rest of the steering system.

Figure 9:
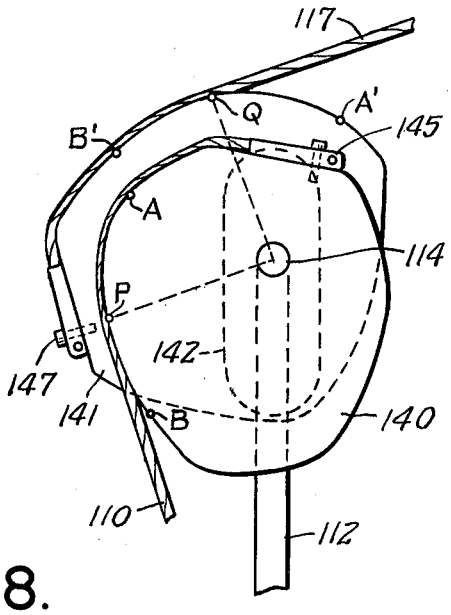
FIG. 9 is a plan view of a cam-type interconnection of a forward rudder and control cable useable in the system of FIG. 6.
Figure 10:
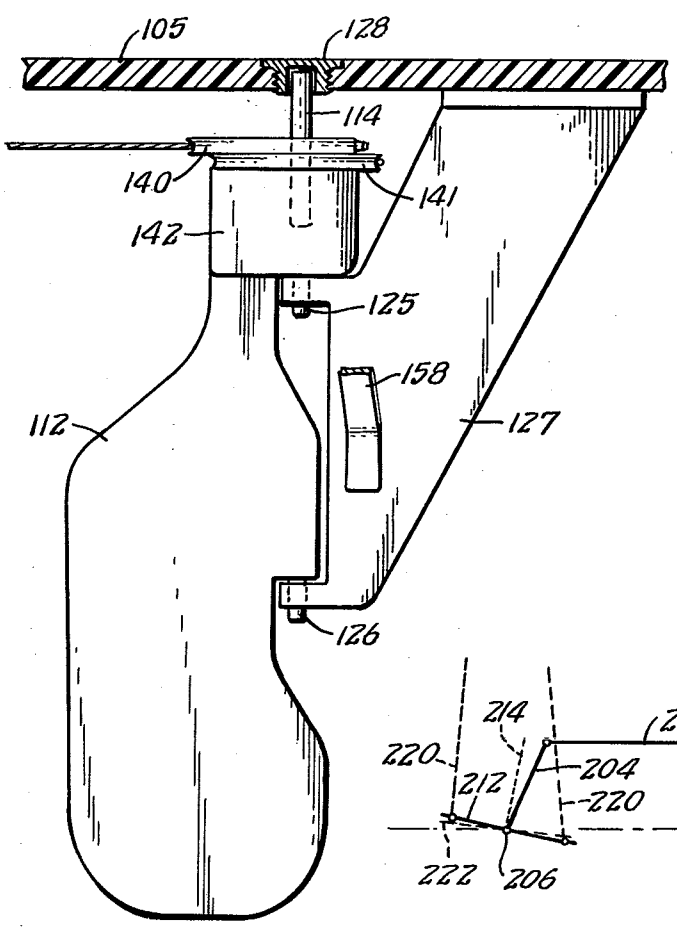
FIG. 10 is a side view, partly in section, of a form of forward rudder useable in the system of FIG. 6.

FIG. 9 shows the cam arrangements for the rudder 112 that swings on the axis of the post 114. FIG. 9 assumes that the rudder 112 is of the form shown in FIG. 10, in which it swings on pintles 125 and 126 that fit into eyes mounted on a skeg 127. The deck fitting 128 above the end of the post 114 is not a support but merely a safety feature in case one of the pintles should break. The type of rudder shown in FIG. 10 is not intended to be raised and lowered. When it is desired to eliminate any steering or other deflection effect of the forward rudders, the spline 121 is removed from the spool 119 at the stern rudder post and the cable 110 is free to move independently of the stern rudder. The forward rudders will then adapt their position to the flow of water around them and will swing like casters on furniture. Instead of the arrangement utilizing the spool 119 shown in FIG. 6, a similar effect could be provided by the arrangement shown in FIGS. 7 and 8 in which the cable 110 passing through leads on the underside of the tiller 108, one of the leads appearing at 130, can be clamped fast to the underside of the tiller by a releasable clamping device 131 more clearly shown in FIG. 8. In this case the cable 110 is provided with a length of colored jacket (not shown in the drawing), red to port and green to starboard, bracketing the position where the cable should be clamped to the tiller when steering with all three rudders is desired. The disadvantage of this system is that the tightness of the cable 110 varies with different positions of the tiller 108 and it may accordingly be necessary to provide a spring device (not shown) to keep the cable tight. In addition, the advance of the cable is not strictly proportional to the angle of rotation of the tiller, but this disadvantage can be taken into account in the shape of the cams provided on the forward rudders. It is assumed for the purpose of FIG. 9 that the spool type of cable connection to the stern rudder as shown in FIG. 6, is used. As shown in FIG. 10, the cams 140 and 141 are mounted on the thickened upper portion 142 of the rudder 112. FIG. 9 shows the position of the cams 140 and 141 when the vessel is being steered straight ahead. In this position the cable 110 leads off the cam 140 at the point P and the cable 117 leads off a cam 141 at the point Q, both P and Q being at the same radius from the center of the post 114 which is the axis on which the rudder turns. This radius has the desired relation to that of the spool 119 which is determined by how much less is the distance of the post 114 to the transverse midships line MM, than is that of the rudder post 120. The line MM is the transverse line passing through the point O which is assumed to be a point about which the vessel tends to rotate when one of the extremities of the main hull 101 is pushed sideways.

When the tiller 108 is pushed from the straight ahead position to the position shown in FIG. 5 (swung to starboard), the end of the cable 110 which is fastened to the cam 140 pulls the rudder 112 to starboard, as shown in FIG. 5. The cable 110 is shown fastened to the cam 140 at 145. The working surface of the cam may be regarded as extending only as far as, for example, the point A, since it may be assumed that even if the rudder 108 were swung around at 90° to the length dimension of the hull, even the more deflected of the two forward rudders would not be swung more than 45° in the case of the present configuration.

The radius of the cam surface on the center of the post 114 reduces as the curve of the cam surface goes around from point P to point A. On the other hand, when the tiller is swung in the opposite direction, the rudder 112 swings to port (to the left in FIG. 5 and FIG. 9) and the rate at which it is swung as the cable 110 is taken up on the cam 140 while the cable 117 is pulled off the cam 141 is determined by the increasing radius of the cam contour between the point P and the point B. At the same time as the cable 110 is taken up by the surface of the cam 140 between the point P and the point B, the cable 117 is pulled off from the surface of the cam 141 between the point Q and the point B', and it can be seen from FIG. 9 that the cable 117 is accordingly pulled off at the same rate as that at which the cable 110 is taken up. The cable 117 is fastened to the cam 141 at 147 and the point A' on the cam 141 is the point at which the cable 117 leaves the cam 141 when the cable 110 feeds onto the cam 140 at the point A. Accordingly, the cable 117 is always paid out at the same rate that the cable 110 is taken up and vice versa, because of the similarity of the cam contours and the fact that they are shifted with respect to each other simply by an angle of the same magnitude as that between the lead-off directions of the cables 110 and 117. The contour of the cam in places other than the working surfaces A,P,B and A',Q',B' can have any desired shape. In FIG. 9 the shape of the working surfaces have been prolonged beyond the sectors that would actually be in use, for purposes of illustrating the nature of the curve, and the remainder has been rounded off in any convenient way consistent with mounting on the top of the thickened portion 142 of the rudder 112.

The rudder 113 is provided with cams in the mirror image of those shown in FIG. 9, and here again the cable 110 is pulled off at the same rate that the cable 117 is respectively pulled off and taken up.

Figure 11:
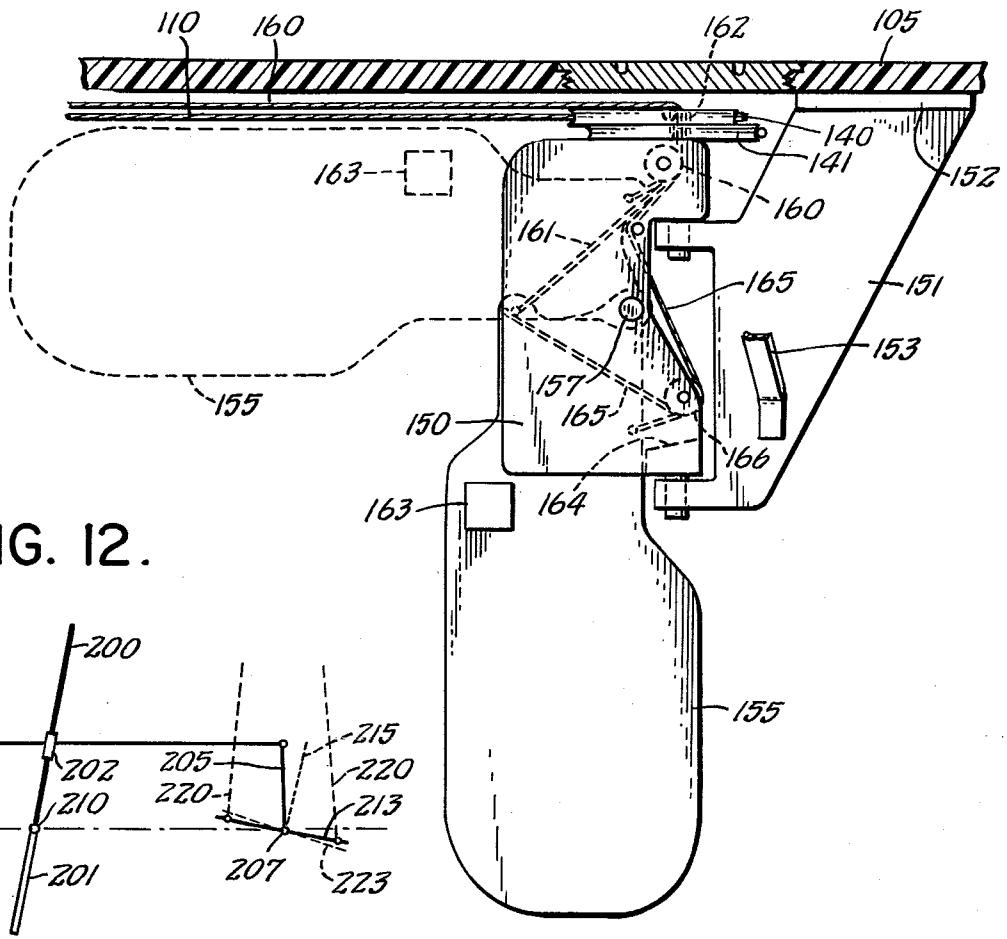
FIG. 11 is an elevation view, partly in section, of another form of forward rudder useable in the system of FIG. 6.

FIG. 11 shows a form of retractable rudder that does not require any projection above the deck level when the rudder is retracted. It illustrates, in effect, that the kinds of "pop-up" rudders used as stern rudders in shallow draft vessels are readily adaptable to the forward rudders for catamarans and trimarans used in the steering systems of the present invention. In the present case, however, the rudder when retracted is designed to be, so far as possible, completely out of the water. In the case of catamarans of cruising size, this is rather easily feasible, but in some designs of trimarans, the deck may be low enough to make that objective more difficult for the rudder on lee side of the main hull, unless these rudders are located fairly close to the main hull.

In FIG. 11, the base element 150 of the rudder, which may be referred to as the rudder frame, is hung on a skeg 151 with a conventional pintle hinge. The skeg 151 is secured to the deck 105 by means of cleats 152 and braces 153. Of course, the skeg 151 may be unnecessary if it is possible to mount the pintle hinge on bracing provided under the deck 105 as part of the inter-hull bracing. The rudder frame 150 consists essentially of two side plates of rigid material within which the rudder blade 155 pivots on a pivot pin 157, between the raised position shown in dashed lines and the lowered position shown in solid lines. The side plates of the rudder frame 150 are joined by intermediate members (not shown) located above and forward of the space between the plates which the rudder blade 155 must be able to occupy.

A pulley 160 is located within the rudder frame in a position suitable for leading the cable 161, by which the rudder is raised from its lowered position, to an axial tube 162 at the top of the rudder frame, the mouth of which is provided with a suitable bearing surface so that the cable 160 can be led aft to a suitable control for the rudder position. A lead weight 163 is set into the rudder blade 155, the position shown in FIG. 11 having been chosen so that the weight will tend to swing the rudder blade forward against an internal stop 164 in the rudder frame 150 even when the rudder blade 155 is in its lowered position. The provision of such a weight should make it unnecessary to provide a cable for pulling the rudder into its lowered position, but FIG. 11 shows a cable 165 for that purpose, as well as a pulley 166 for that function, which may be used either instead of the weight 163 or as a supplement thereto. If the cable 165 is not necessary in a particular case, the peculiar shaping of the forward edge of the rudder frame shown in FIG. 11, of course, becomes unnecessary. The points of attachement of the cables 161 and 165 can be chosen so that the amount of one cable that is paid out in moving the rudder from one position to the other is equal to the amount of the other cable that is pulled in during the same operation, so that both cables can be operated from a common control (not shown). Instead of being brought upwards over the pulley 166, the cable 165 could be led forward, upward and then aft in smooth arc by a curved tube set in the skeg 151, an arrangement that would be easy to provide if the skeg 151 were molded of fiber-reinforced resin. When the cable 165 and its pulley 166 are not used, the depth of the skeg and of the frame part of the rudder can be reduced.

At the top of the rudder frame 150 are shown cams 140 and 141 of the kind shown in FIG. 10. In this case, however, it should be noted that the cam 140, which carries the cable 110 leading aft towards the stern rudder, is the upper one of the two cams, so as to be able to clear the rudder blade 155 better when the latter is in its raised position. Of course, the rudder 150 could carry cross-arms instead of cams and, particularly, a cross-arm as in FIG. 3 when the type of rudder shown in FIG. 11 is used for the forward center rudder of a catamaran.

Figure 8:
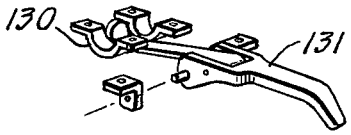
FIG. 8 is a detail, in partially exploded view, of the releasable clamp of the arrangement of FIG. 7.
Figure 7:
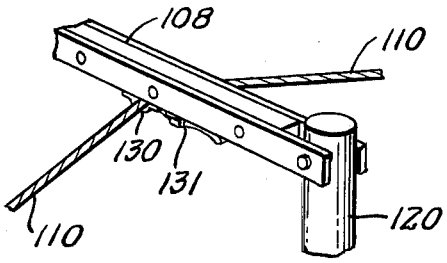
FIG. 7 is a similar perspective detail view of an alternative for the arrangement of FIG. 6.

It will therefore be evident that a wide variety of retractable rudders are available for the forward rudders used in steering systems according to the present invention and that the use of a retractable rudder is not necessary for the forward rudder, particularly if a control release is provided as discussed in connection with FIGS. 6, 7 and 8. The operation of raising the rudder, however, is no more difficult than that of raising a centerboard, so that devices of this type are entirely practical for steering systems in which it is desired to use the forward rudder or rudders only on the closer points of sailing and when a sharp change of course or maneuvering in a harbor is to be done.

The various features described in the foregoing description are not limited to their particular context. Thus, for example, cross-arms for a cable linkage and a link rod between the lateral rudders could be used in FIG. 5 as well as in FIG. 1, although of course it would appear to be preferable to link the forward rudders 112 and 113 of FIG. 5 by cables rather than by a link rod that would have to pass through or over the hull 101.

It should be noted, however, that it is not necessary to link the forward rudders 112 and 113 of FIG. 5 directly to each other, as by the cable 117 or by an equivalent rod and arm system, as just mentioned, in order to constitute a steering system in accordance with the invention. Thus, the rudders 112 and 113 could each be individually linked in a double-acting manner with the stern rudder 119. For example, the cable 117 could be split into two parts and each part lengthened, with one part leading back from the cam 141 on the shaft 114 to the spool 119 on the rudder shaft 120, and the upper half leading back in a similar manner from a cam around the shaft 115 to the spool 119. In this case it would be important that the cables 117 should be taken up and paid out by the cams respectively on the shaft 114 at the same rate at which the adjacent ends of the cables 110 are, conversely, paid out and taken up around the shaft 115, since the stern ends of these pairs of cables would be wound around the same spool on the stern rudder. In the arrangement of FIG. 5, however, both of the cams on which the cable 117 goes could be conformally reduced or increased in size without change of the cams on which the cables 110 terminate, so long as the cam shapes preserve the desired different rates of turning of the shafts 114 and 115, so that the rudder at the inside of a turn being made would be always deflected more than the one on the outside of the turn.

Figure 2:
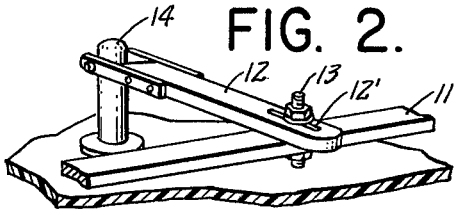
FIG. 2 is a perspective sketch of a portion of the tiller link rod or the stern rudders of a system of the type of FIG. 1, together with other components of the system attached to its center.

In the kind of arrangement just mentioned above, in which the shafts 114 and 115 of the forward rudders of a trimaran are not directly linked to each other as shown in FIG. 5, but are each individually controlled by a linkage to the shaft 120 of the stern rudder. It is possible to use a cross-rod linkage to provide the different rate of turning of the forward rudders similar to the arrangement shown in FIG. 1 for producing the same effect between the stern rudders 7 and 8. This is illustrated diagramatically in FIG. 12 where a tiller 200 controlling a stern rudder 201 is linked by a pin and slot linkage 202, similar to that shown in FIG. 2, to a cross-rod 203 connected at its ends by a pivot linkage to the inwardly offset control arms 204 and 205 mounted on the jack shafts 206 and 207, which are stub shafts parallel to the turning axis 210 of the rudder 201. The pivot linkages are indicated by open circles to distinguish them from the solid circles indicating the rudder post and jack shafts. The jack shaft 206 carries a cross-arm 212 and the jack shaft 207 similarly carries a cross-arm 213. The dotted lines 214 and 215 are respectively perpendicular to the cross-arms 212 and 213 and show the offsetting of the arms 204 and 205 that is provided to produce the desired motion. The cross-arms are connected by crossed pairs of cables 220 running below the inter-hull decks to control in each case (that is, on each side of the main hull) a forward rudder, not shown in FIG. 12, which is likewise provided with a cross-arm for control in a reverse direction.

Figure 12:
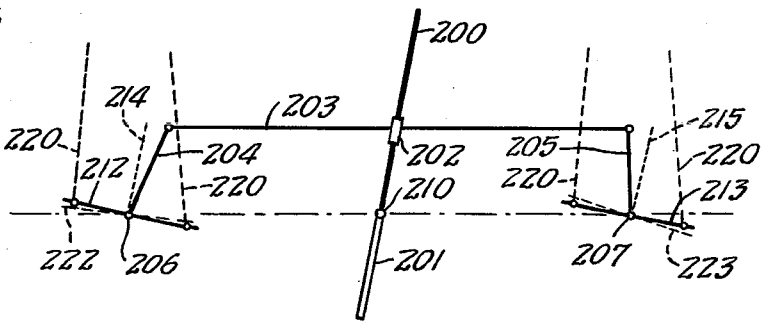
FIG. 12 is a partial diagram of a modification of the steering system of FIG. 5.

In the case just illustrated it is not practical to put the jack shafts 206 and 207 on the opposite side of cross-rod 203 from the rudder post 210, which would provide the reversal of steering direction without requiring the crossing of the cables, because so doing would increase the deflection of the forward rudders as the main rudder 201 swings farther off center because of the lengthening effective radius of the slot linkage 202. In the arrangement of FIG. 12 the effective radius of the slot linkage 202 varies rather little, because the middle of the cross-rod 203 moves somewhat closer to the rudder post 210 as the tiller 200 moves away from the center position, tending to keep the radius of the connection between the tiller 200 and the cross-rod 203 more constant. If it should be desired, however, to have the forward rudder deflection very small when the rudder 201 is near center position and to have it increase considerably when the tiller 200 is put far over, the arrangement previously discussed with the jack shafts 206 and 207 placed forward of the cross-rod 203 could be used.

Similarly, the decrease in the incremental rate of steering of the forward rudder for wide deflections of the stern rudders in the arrangement of FIG. 1 could be reduced by putting the jack shaft 14 astern of the cross-link rod 11, in which case it could be located in line with the axes of the stern rudders or, if desired, it could be placed somewhat further astern in order to provide for some of the reduction of the steering motion to be transmitted to the forward rudder 17.

To return briefly to FIG. 12, it should be noted that this diagram assumes that the forward rudders not shown in the drawing are directly forward of the respective jack shafts 206 and 207. Of course, it may be more convenient to have the jack shafts 206 and 207 and their respective cross-arms located just outside the main hull (not shown) below an extension of the deck, or of the stern transom in the case in which the rudder 201 is mounted directly on the transom, rather than below the stern overhang, while the forward rudders are spaced substantially farther apart, because at their location the main hull is wider and, besides, the forward rudders should swing where their steering characteristics will not be adversely affected by excessive proximity to the main hull. When the spacing of the forward rudders is greater than that between the jack shafts 206 and 207, of course, the cross-arms 212 and 213 are offset so that when the rudder 201 is in its center position, each cross-arm will be so oriented as to be perpendicular to the direction from its jack shaft to the axis of rotation of the forward rudder that it controls. Such an offsetting to allow for the wider spacing of the forward rudders is illustrated by way of example by the dashed lines 222 and 223 corresponding respectively to the cross-arms 212 and 213 in FIG. 12.

Although a variety of steering systems according to the present invention has been described in the foregoing specification, additional variations and elaborations may be made within the inventive concept. For example, the jack shaft 14, either in the position shown in FIGS. 1 or 2, or in the different position mentioned in the preceding paragraph, could be used for the main steering position of a cruising catamaran and provided either with a tiller or with a steering wheel and its mechanism. Rather more interesting is the possibility of utilizing the central portion of the cables 117 of FIG. 5 for engagement with a steering wheel in the forward part of the cabin 104 in FIG. 5. In a similar way, the forward rudder of a catamaran, particularly if mounted on a shaft braced on the forward wall of a trunk cabin spanning the deck between the hull of the vessel, could be connected with a steering wheel that would provide a sheltered forward steering position for the vessel.

Finally, it should be added that since trimarans are designed to heel enough in a cross wind to lift the windward hull out of the water, it may be desired to set the turning axes of the forward rudders slightly off the vertical, respectively to one side and the other, so that the turning axis of the rudder will be vertical when the rudder in question is the rudder on the lee side of the boat and the boat is heeled at some normal sailing angle. Furthermore, in determining the necessary spacing of the rudders from the main hull, it should be remembered that the greater extent of rudder deflection in the system of FIG. 5 is always towards the main hull, i.e. when the particular rudder is on the inner side of the turn being performed.

I claim:

1. A steering system for a multihull boat having at least two parallel elongated hull bodies providing for flotation of a structure maintaining said hull bodies in substantially fixed relation to each other, said steering system comprising:

aft steering means including at least one rudder mounted at least partly below the waterline on the stern portion of at least one of the hulls of the boat;

forward steering means including at least one rudder mounted forward of amidships on said structure, extending below the waterline level in at least one space between two hulls and pivoted on an axis located between said two hulls and abreast of the normally submerged portion of at least one of said two hulls, said location being, in terms of the fore-and-aft dimension, closer to the location about which the boat normally pivots when tacking about when sailing close-hauled than is the location of said aft steering means;

means for mechanically linking said aft steering means and said forward steering means for simultaneous control of both of them and for causing the after edge of said at least one rudder of said forward steering means to be deflected to the side opposite to that to which said at least one rudder of said aft steering means is deflected, said linking means so connecting said steering means that when one of said rudders is in its center position, all of said rudders are in their respective center positions, and so that the mean angular rudder deflection of said forward steering means is always less than the mean angular rudder deflection of said aft steering means when rudders of said respective steering means are deflected from center position, and steering control means for simultaneously operating said aft and forward steering means and said linking means by means of a single control motion.

2. A steering system for a sailing catamaran comprising, in combination:

a pair of aft rudders respectively mounted on the after portion of each hull of the catamaran;

a forward rudder mounted on the structure between the hulls on the fore-and-aft centerline of the catamaran aft of the line joining the forward ends of the waterlines of the hulls and forward of the point or points of the catamaran structure about which the catamaran tends to pivot when tacking about when sailing close-hauled; said forward rudder having at least the major portion of its steering blade aft of its turning axis;

means for linking the steering motions of said aft rudders and said forward rudder for producing simultaneous operation thereof in which operation said aft rudders are constrained to swing in the same direction while said forward rudder at the same time swings in the opposite direction and with an angular deflection from center position that is substantially less than the mean angular deflection from center position of said aft rudders, and means in at least one steering location for controlling the position of said rudders and said linking means by a unitary controlling force.

3. A steering system for a catamaran as defined in claim 2, in which the deflection of said forward rudder away from its center position is less than the average of the respective deflections of said aft rudders from their center positions substantially in proportion to the respective distances by which said forward rudder and said aft rudders are respectively forward and aft of the point or the mean of the points about which the catamaran tends to pivot when tacking about in working to windward.

4. A steering system for a catamaran as defined in claim 2, in which said linking means includes a tie rod pivotally connected with pivots having fixed relations with said aft rudders and respectively located at the same distance from said aft rudders, said tie rod measuring between the respective axes of said pivots substantially less than the distance between the turning axes of said aft rudders and in which said linking means includes a jack shaft linked with the center of said tie rod by a radius member and means for transmitting the rotary motion of said jack shaft to produce rotary motion, about its turning axis, of said forward rudder.

5. A steering system for a catamaran as defined in claim 4, in which said means for transmitting rotary motion of said jack shaft to produce rotary motion of said forward rudder includes cross arms on said jack shaft and on said forward rudder and cables connecting in each case an extremity of the cross arm on said jack shaft with an extremity of the cross arm on said forward rudder.

6. A steering system for a catamaran as defined in claim 4, in which said jack shaft is located forward of said tie rod.

7. A steering system for a catamaran as defined in claim 2, in which means are provided for raising said forward rudder at least in large part out of the water and for lowering said forward rudder from its raised position into steering position.

8. A steering system for a catamaran as defined in claim 2, in which said linking means are provided with means for disconnecting said forward rudder from said control means and from said aft rudders, and for reconnecting said forward rudder thereto.

9. A steering system for a sailing catamaran having at least one mast comprising, in combination:

a pair of aft rudders respectively mounted on the after portion of each hull of said catamaran;

a forward rudder mounted on an axis in the neighborhood of an approximately parallel to a mast of said catamaran which is not aft of any other mast thereof, said forward rudder having at least the major portion of its steering blade aft of its turning axis;

means for linking the steering motions of said aft rudders and said forward rudder for producing simultaneous operation thereof in which operation said aft rudders are constrained to swing in the same direction while said forward rudder, at the same time, swings in the opposite direction, said linking means being so constituted that the deflection of said forward rudder away from the center position is substantially smaller than the average of the deflections of said aft rudders away from their respective center positions, and means in at least one steering location for controlling the position of said rudders and said linking means by a unitary controlling force.

10. A steering system for a catamaran as defined in claim 9, in which said linking means are so constituted that the deflection of that one of said aft rudders which is on the inside of a turn to be performed in response to said deflection is greater than the deflection of the other of said aft rudders.

11. A steering system for a catamaran as defined in claim 9, in which said linking means include a tie rod linking pivots respectively mounted in fixed relation to said aft rudders and forward of the respective axes of said aft rudders for constraining said aft rudders to swing in the same direction;

a jack shaft having a radius rod slotlinked to the center of said tie rod for causing said jack shaft to rotate in the direction opposite to the direction of rotation of said aft rudders, and cross arms on said jack shaft and on said forward rudder and connecting cables between said respective cross arms for constraining said forward rudder to swing in the direction opposite to the swing of said aft rudders with an amplitude of swing that is substantially less than that which corresponds to the rotation of said jack shaft.

12. A steering system for a catamaran as defined in claim 9, in which means are provided for raising said forward rudder at least in large part out of the water and for lowering said forward rudder from its raised position into steering position.

13. A steering system for a catamaran as defined in claim 9, in which said linking means are provided with means for disconnecting said forward rudder from said control means and from said aft rudders, and for reconnecting said forward rudder thereto.

14. A steering system for a sailing trimaran having a central hull and port and starboard outrigger hulls, comprising, in combination:

an aft rudder mounted on the after portion of the central hull;

a first forward rudder having its turning axis located in the space between said port outrigger hull and the portion of the central hull aft of the bows of the outrigger hulls and aft of the forward end of the waterline of the central hull;

a second forward rudder having its turning axis located in the space between said starboard outrigger hull and the portion of the central hull aft of the bows of the outrigger hulls and aft of the forward end of the waterline of the central hull, both of said forward rudders being located more forwardly than the point or points of the trimaran structure about which the trimaran tends to pivot when steered about while sailing close-hauled;

means for linking the steering motions of said forward rudders and said aft rudder for producing simultaneous operation thereof, in which operation said forward rudders are constrained to swing in the same direction while said aft rudder at the same time swings in the opposite direction, said linking means being so constituted that when said aft rudder is deflected away from its center position, said forward rudders are deflected to the other side of their respective center positions and the mean magnitude of the angular deflection of said forward rudders is substantially smaller than the magnitude of the angular deflection of said aft rudder, and means in at least one steering location for controlling the position of said rudders and said linking means by a single unitary controlling force.

15. A steering system for a trimaran as defined in claim 14, in which said linking means are so constituted that when said aft rudder is deflected away from its center position, that forward rudder which is on the side of the central hull to which said aft rudder is deflected is thereby deflected to a greater extent than the other of said forward rudders.

16. A steering system for a trimaran as defined in claim 15, in which said linking means are so constituted that said mean magnitude of the angular deflection of said forward rudders is less than the angular deflection of said aft rudder substantially in proportion to the relative extent to which the turning axes of said forward rudders are located forwardly and the turning axis of said aft rudder is located aft, respectively, at the point or at the mean location of the points of the trimaran structure about which the trimaran tends to pivot when steered about when sailing close-hauled.

17. A steering system for a trimaran as defined in claim 15, in which means are also provided for raising and lowering said forward rudders so as to reduce or increase their steering effect.

18. A steering system for a trimaran as defined in claim 15, in which said linking means are provided with means for disconnecting said forward rudders from said stern rudder and allowing them to assume positions under the influence of the surrounding water without opposition from a steering force applied by said controlling means to said aft rudder.

19. A steering system for a trimaran as defined in claim 14, in which cams are provided on the upper portion of said forward rudders and a spool on the upper portion of said aft rudder respectively and cables are provided for interconnecting said cams and spool in such a way that the deflection of each of said forward rudders is determined for every steering position of said aft rudder.

20. A steering system for a trimaran as defined in claim 19, in which said cams are so shaped that a cable is paid off from each of the rudders at the same rate as a cable is taken up at the same rudder.

21. A steering system for a trimaran as defined in claim 19, in which one of said cables connects cams respectively located on said forward rudders by passing across the central hull of the trimaran.

22. A steering system for a trimaran as defined in claim 14, in which said linking means include double-acting means linking said aft rudder to said port forward rudder and double-acting linking means linking said aft rudder to said starboard forward rudder.

23. A steering system for a trimaran as defined in claim 22, in which said linking means include jack shafts spaced from said stern rudder and located respectively on opposite sides thereof externally to the central hull of said trimaran and radius rods and a tie rod for causing said jack shafts to be rotated in the same direction as the rotation of said aft rudder about its steering axis, and means for transmitting the rotation of said jack shafts respectively to said forward rudders in such a way as to cause said forward rudders to rotate about their respective steering axes in the direction opposite to the rotation of said jack shafts.

* * * * *